United States Patent [19]

Kardos

[11] Patent Number: 4,884,963

[45] Date of Patent: Dec. 5, 1989

[54] PULSE COMBUSTOR

[75] Inventor: Peter Kardos, Longmeadow, Mass.

[73] Assignee: Gas Research Institute, Chicago, Ill.

[21] Appl. No.: 229,130

[22] Filed: Aug. 5, 1988

[51] Int. Cl.[4] ..... F23C 11/04

[52] U.S. Cl. ..... 431/1; 60/39.77; 60/247; 122/24

[58] Field of Search ..... 431/1; 122/24; 60/39.77, 247, 39.8

[56] References Cited

U.S. PATENT DOCUMENTS

| | | | |
|---|---|---|---|
| 1,170,834 | 2/1916 | Lovekin . | |
| 3,554,182 | 1/1971 | Whitacre | 431/1 X |
| 3,665,153 | 5/1972 | Asakawa | 122/17 X |
| 4,241,723 | 12/1980 | Kitcher | 122/24 X |
| 4,257,355 | 3/1981 | Cook | 122/17 |
| 4,314,444 | 2/1982 | Putnam et al. | 122/24 X |
| 4,465,024 | 8/1984 | Adams | 122/17 |
| 4,545,329 | 10/1985 | Adams | 122/17 |
| 4,637,792 | 1/1987 | Davis | 431/1 |
| 4,651,712 | 3/1987 | Davis | 431/1 X |

FOREIGN PATENT DOCUMENTS

| | | | |
|---|---|---|---|
| 826137 | 5/1981 | U.S.S.R. | 431/1 |

*Primary Examiner*—Margaret A. Focarino

*Attorney, Agent, or Firm*—Thomas W. Speckman; Douglas H. Pauley

[57] ABSTRACT

A pulse combustor having a combined mixing and ignition chamber in communication with a fuel inlet tube and an air inlet tube. The fuel inlet tube and air inlet tube inject fuel and air, respectively, forming a fuel/air mixture in the mixing and ignition chamber. An ignition source for igniting the fuel/air mixture is located within the mixing and ignition chamber. A main combusiton chamber is sealably secured to the main combustion chamber wall and in comunication with the mixing and ignition chamber. The main combustion chamber first splits into a plurality of downstream combustion chamber branches, each of which further split into a plurality of exhaust tubes. The combustion chamber branches of the main combustion chamber have a slot between the combustion chamber branches. At least one reinforcing strut is secured between the combustion chamber branches within the slot between the combustion chamber branches of the main combustion chamber. A plurality of exhaust tubes each have a chamber end in communication with the main combustion chamber and/or combustion chamber branches. Each exhaust tube has an exhaust manifold end in communication with an exhaust manifold.

26 Claims, 2 Drawing Sheets

PULSE COMBUSTOR

BACKGROUND OF THE INVENTION

1. Field of the Invention

A pulse combustor having a combined mixing and ignition chamber in communication with a combustion chamber having combustion chamber branches. A plurality of exhaust tubes extend from the combustion chamber to an exhaust manifold.

2. Description of the Prior Art

Pulsing combustion devices are known to the art. Davis, U.S. Pat. No. 4,637,792 describes a pulsing combustion device having a combustion chamber and a floating valve member mounted in reciprocal relation in the wall of the combustion chamber where reciprocation of the floating valve closes and opens communication through ports between the supply of a combustible mixture and the combustion chamber. The '792 patent teaches a single elongated combustion chamber burner shell which defines a combustion chamber. Davis, U.S. Pat. No. 4,651,712 teaches a pulsing combustion device having a combustion chamber with an inlet for a combustible mixture and an unvalved outlet open to the atmosphere for combustion gases. The '712 patent describes an elongated combustion chamber shell or burner shell which defines a combustion chamber. The combustible mixture is ignited and burned in a single combustion chamber.

Adams, U.S. Pat. 4,465,024 and Adams, U.S. Pat. No. 4,545,329 teach a water heater having a water tank with a water inlet, a water outlet, and an opening in the side wall of the tank. The combustion chamber assembly has a submergible portion which is adapted to fit within the opening in the tank side wall. The submergible combustion chamber portion comprises a single cylindrical elongated member having an open end and an opposite closed end. A plurality of curved fire tubes are joined to and extend from the closed end of the combustion chamber to a single flue. The Adams patents disclose power combustion systems where fuel and air are force fed to the point where combustion occurs.

Cook, U.S. Pat. No. 4,257,355 teaches a cold water inlet tube located in a horizontal position adjacent the bottom of a commercial water heater. The water heater has a tank formed of a cylindrical shell which is enclosed by a lower head and a upper head. A plurality of vertical flues are disposed inside the tank and extend from the end of the combustion chamber to a single flue. The system operates with a natural draft venting system and not a pulse combustion system.

Asakawa, U.S. Pat. No. 3,665,153 teaches an apparatus and method for heating water to generate steam or provide hot water. A burner is positioned in a combustion chamber having heat exchanger pipes passing from one end of the combustion chamber to a chimney. The combustion system operates with a natural draft venting system, not an acoustically tuned pulse combustion system.

Lovekin, U.S. Pat. No. 1,170,834 teaches a thermostatic valve mechanism which supplies gas to a burner of a heater. FIG. 1 of the '834 patent shows a single corrugated combustion chamber with a flue exiting from one end.

SUMMARY OF THE INVENTION

It is an object of this invention to provide a pulse combustor having a combustion chamber which properly aspirates and does not create excessive noise levels.

It is another object of this invention to provide a pulse combustor that is easy to manufacture and requires no special machining, dies, molds or the like.

It is yet another object of this invention to provide a pulse combustor having a single cavity combustion chamber which splits first into a plurality of combustion chamber branches, further into a plurality of exhaust tubes and thus has greater surface area for increased heat transfer.

It is yet another object of this invention to provide a pulse combustor which has a single mixing and ignition chamber.

It is yet another object of this invention to provide a pulse combustor having a single combustion chamber which splits into a plurality of combustion chamber branches each having a cross-sectional area less than the cross-sectional area of the single combustion chamber.

In a preferred embodiment of this invention, a pulse combustor has a combined mixing and ignition chamber in communication with a fuel inlet tube and an air inlet tube. The fuel inlet tube and air inlet tube inject fuel and air, respectively, to form a fuel/air mixture in the combined mixing and ignition chamber. The combined mixing and ignition chamber has an ignition source located within the mixing and ignition chamber for igniting the fuel/air mixture.

The pulse combustor also has a combustion chamber in communication with the mixing and ignition chamber. The combustion system has a single combustion chamber which first splits into a plurality of downstream combustion chamber branches, then each downstream combustion chamber branch further splits into at least one, preferably a plurality of exhaust tubes. The combustion chamber branches of the combustion chamber have a slot between the combustion chamber branches. At least one reinforcing strut is secured to the wall of the combustion chamber branches within the slot between the combustion chamber branches.

At least one exhaust tube has a chamber end sealably secured to and in communication with the wall of the combustion chamber. Each exhaust tube has an exhaust manifold end sealably secured to and in communication with an exhaust manifold.

The fuel inlet tube is sealably secured to the wall of the mixing and ignition chamber and is in communication with a mixing and ignition chamber. Likewise, the air inlet tube is sealably secured to the wall of the mixing and ignition chamber and is in communication with the mixing and ignition chamber. Each combustion chamber branch has a cross-sectional area less than the cross-sectional area of the main combustion chamber. Each exhaust tube has a cross-sectional area less than the cross-sectional area of the combustion chamber branch with which the exhaust tube is in communication.

According to one embodiment of this invention, the main combustion chamber and its combustion chamber branches have corrugated sides for increased heat transfer. In another embodiment of this invention, the main combustion chamber and its combustion chamber branches have at least one fin secured to and extending from at least one side of the combustion chamber, including its combustion chamber branches, for increased heat transfer.

DESCRIPTION OF THE PREFERRED EMBODIMENTS

Pulse combustion is an acoustically controlled oscillating combustion where sinusoidal pressure waves are generated in a combustion chamber. After initial ignition, combustion will continue without further ignition from an ignition source such as a spark plug or the like. The frequency of oscillation within the combustion chamber is a function of the combustion chamber volume and the total cross-sectional area of the exhaust tubes.

One major advantage of this invention is the greatly enhanced heat transfer as compared with the heat transfer achieved in a conventional combustor. In a combustor according to this invention, a major portion of heat transfer occurs through the walls of the combustion chamber thus a configuration having increased surface area without a proportional increase in the volume of the combustion chamber provides greater heat transfer.

Figure 1:
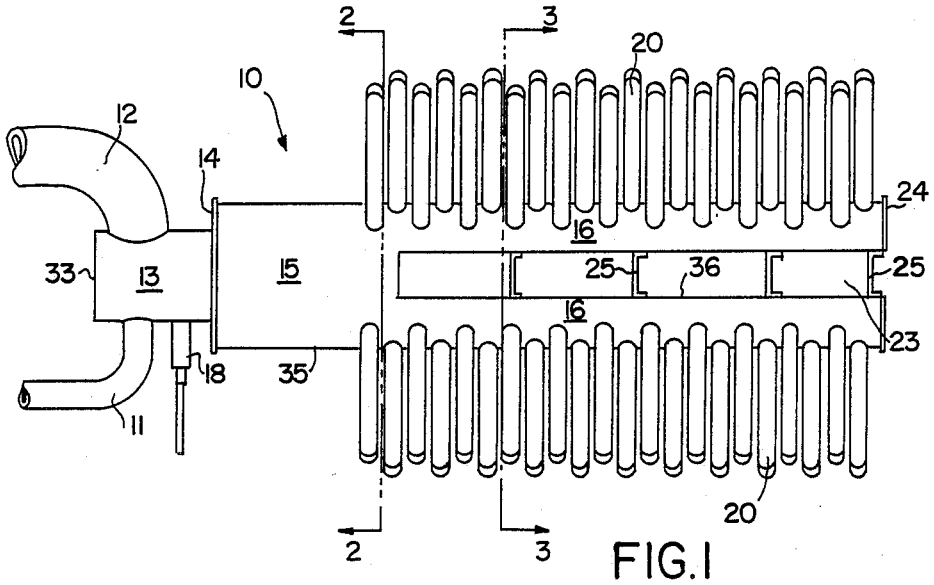
FIG. 1 shows a top view of a pulse combustor having a main combustion chamber with two combustion chamber branches and a plurality of exhaust tubes according to one embodiment of this invention, FIG. 1 does not show the exhaust manifold of the pulse combustor.
Figure 2:
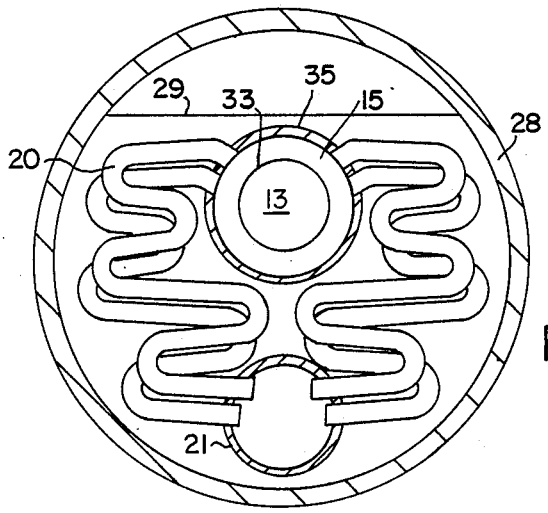
FIG. 2 shows a cross-sectional view along line 2—2 of a submerged pulse combustor as shown in FIG. 1.
Figure 3:
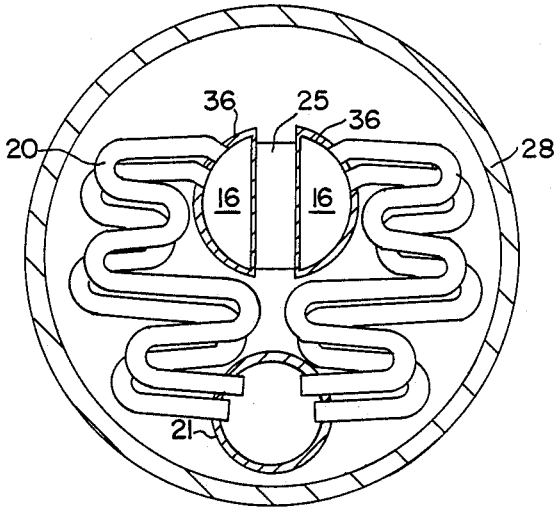
FIG. 3 shows a cross-sectional view along line 3–3 of a pulse combustor, as shown in FIG. 1, within a shell but without the liquid shown.

In a preferred embodiment of this invention as shown in FIGS. 1, 2 and 3, pulse combustor 10 has fuel inlet tube 11 and air inlet tube 12 sealably secured to mixing and ignition chamber wall 33 and in communication with mixing and ignition chamber 13 as defined by mixing and ignition chamber wall 33. It is apparent that fuel inlet tube 11 and air inlet tube 12 can be sealably secured to mixing and ignition chamber wall 33 by a welded connection, a screwed connection, by having fuel inlet tube 11 and air inlet tube 12 as channels within a block in lieu of tubes, or the like. Fuel inlet tube 11 injects fuel and air inlet tube 12 injects combustion air into mixing and ignition chamber 13 forming a combustible fuel/air mixture within mixing and ignition chamber 13.

An ignition source is located within mixing and ignition chamber 13 for igniting the fuel/air mixture within mixing and ignition chamber 13. It is apparent that ignitor 18 can be a spark plug, glow plug or other ignition source known to the art. Once combustion occurs from an initial ignition source, pulse combustor 10 will operate and combustion will continue without further ignition from the initial ignition source, such as the spark plug, glow plug or the like.

Main combustion chamber 15 as defined by main combustion chamber wall 35 is in communication with mixing and ignition chamber 13. In a preferred embodiment of this invention, main combustion chamber 15 has transition plate 14 sealably secured to one end of main combustion chamber wall 35. Transition plate 14 has a through hole in communication with mixing and ignition chamber 13. It is apparent that mixing and ignition chamber wall 33 can secure to either transition plate 14 or combustion chamber wall 35 by a welded connection, a screwed connection, by having mixing and ignition chamber wall 33 and main combustion chamber wall 35 one molded piece, or the like.

As shown in FIG. 1, main combustion chamber 15 splits into a plurality of downstream combustion chamber branches 16 as defined by combustion chamber branch walls 36. A plurality of exhaust tubes 20 are attached to main combustion chamber wall 35 and/or combustion chamber branch wall 36 along a longitudinal axis of main combustion chamber 15. FIGS. 1 and 3 show main combustion chamber 15 having two combustion chamber branches 16 and several exhaust tubes 20. FIGS. 4, 5, 6 and 7 show main combustion chamber 15 having four combustion chamber branches 16. It is apparent that main combustion chamber 15 can split into two or more downstream combustion chamber branches 16. Such branching arrangement provides increased heat transfer by providing more surface area and increased contact of the combustion gases with the inside surfaces of the heat exchanger.

Combustion chamber branches 16 have slot 23 located between combustion chamber branches 16 of main combustion chamber 15. In a preferred embodiment of this invention, at least one reinforcing strut 25 spans slot 23 and is secured between combustion chamber branch walls 36. Reinforcing strut 25 provides rigid support for combustion chamber branch walls 36.

In a preferred embodiment of this invention, combustion chamber branches 16 of main combustion chamber 15 have end plates 24 sealably secured to combustion chamber branch walls 36. It is apparent that combustion chamber branches 16 can be sealed by having combustion chamber walls 36 welded together, by having one molded piece, by being connected to another chamber or tube, or the like.

Depending upon the specific design of pulse combustor 10 combustion can be completed either in main combustion chamber 15 or combustion can begin in main combustion chamber 15 and carry into combustion chamber branches 16 for completion of combustion. Whether complete combustion occurs in main combustion chamber 15 or carries into combustion chamber branches 16 depends upon the total volume and configuration of main combustion chamber 15 and combustion chamber branches 16. The location of complete combustion also depends upon the flame speed, reaction time, and the number, spacing and size of exhaust tubes 20. In a preferred embodiment of this invention, complete combustion occurs within main combustion chamber 15 and does not carry into combustion chamber branches 16.

As shown in FIGS. 1, 2 and 3, each exhaust tube 20 has a chamber end sealably secured to and in communication with main combustion chamber wall 35 and/or combustion chamber branch wall 36. Each exhaust tube 20 also has an exhaust manifold end sealably secured to and in communication with exhaust manifold 21 as shown in FIG. 2. In one embodiment of this invention, a plurality of exhaust tubes 20 are sealably secured to main combustion chamber wall 35 and combustion chamber branch walls 36 along a longitudinal axis of main combustion chamber 15 and along the longitudinal axis of combustion chamber branches 16. Such longitudinal arrangement provides increased heat transfer by providing more surface area for heat exchange. It is apparent that exhaust tubes 20 can be sealably secured to main combustion chamber wall 35 and/or combustion chamber branch walls 36 and exhaust manifold 21 by using welded connections, screwed connections, channel means or the like.

In a preferred embodiment of this invention, exhaust tubes 20 have a downwardly sloped and staggered configuration as shown in FIGS. 2 and 3. It is apparent that exhaust tubes 20 can have other tortuous shaped configurations. However, staggered exhaust tubes 20 provide a convenient configuration for attaching a plurality of exhaust tubes 20 to main combustion chamber wall 35 and/or combustion chamber branch walls 36. Downwardly sloped exhaust tubes 20 prevent water or condensation from the flue gas from collecting in exhaust tubes 20. With the downwardly sloped configuration, any condensate can drain into exhaust manifold 21 from which such condensation can be easily removed. Condensation will collect either during initial start-up of a relatively cold pulse combustor 10 or when pulse combustor 10 acts as a condensing unit and achieves very high thermal efficiencies.

Figure 6:
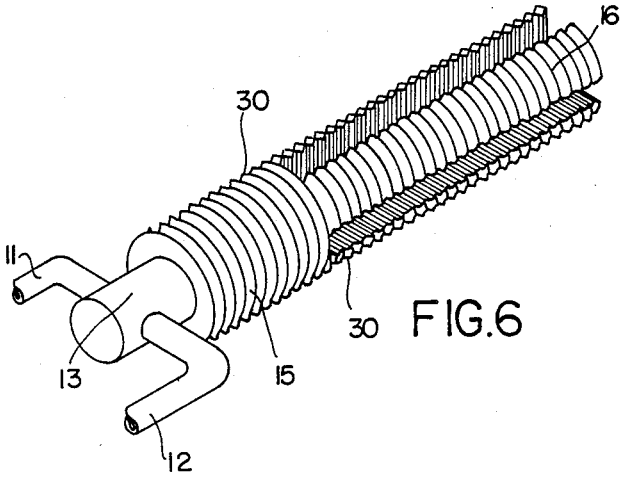
FIG. 6 shows a perspective view of a pulse combustor with the main combustion chamber and four combustion chamber branches having corrugated sides according to one embodiment of this invention.

Each combustion chamber branch 16 has a cross-sectional area less than the cross-sectional area of main combustion chamber 15. Each exhaust tube 20 has a cross-sectional area less than the cross-sectional area of the combustion chamber branch 16 to which the exhaust tube 20 is in communication. Exhaust tubes 20 can be secured to main combustion chamber wall 35 and/or combustion chamber branch walls 36 at a location where combustion is nearly complete, preferably exhaust tubes 20 are secured to combustion chamber branch walls 36 so that the combustion gases flow through combustion chamber branches 16 providing heat transfer to combustion chamber branch walls 36 rather than flowing primarily through the path of least resistance which would be those exhaust tubes 20 secured to main combustion chamber wall 35. In one embodiment of this invention, main combustion chamber wall 35 and combustion chamber branch wall 36 are corrugated and thus provide greater surface area for increased heat transfer. FIGS. 6 and 7 show main combustion chamber wall 35 and combustion chamber branch walls 36 having corrugations. It is apparent that main combustion chamber wall 35 and/or combustion chamber branch wall 36 can have fins or other heat transfer means secured to the walls for increased heat transfer.

Figure 4:
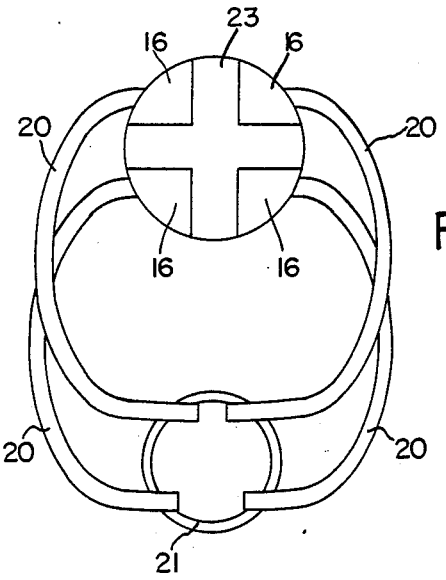
FIG. 4 shows an end view of a pulse combustor having a main combustion chamber with four combustion chamber branches and two slots according to one embodiment of this invention.
Figure 5:
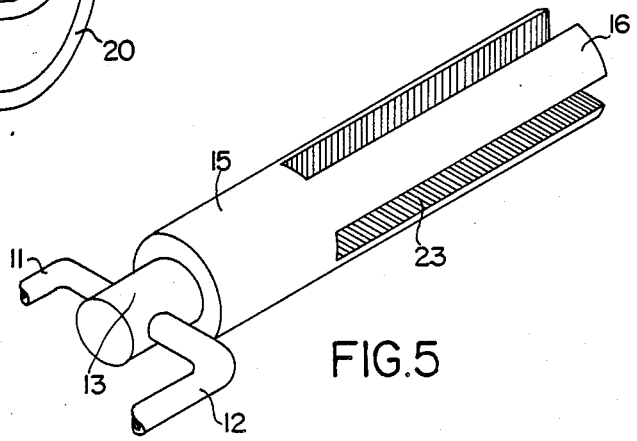
FIG. 5 shows a perspective view of a pulse combustor having a main combustion chamber with four combustion chamber branches and two slots according to one embodiment of this invention.

FIGS. 4, 5 and 6 show main combustion chamber 15 having four combustion chamber branches 16. As shown in FIG. 4, a plurality of exhaust tubes 20 have a downwardly sloped and curved configuration extending between main combustion chamber 15 and exhaust manifold 21. It is apparent that pulse combustor 10, including exhaust tubes 20, can fit within shell 28, or the like, as shown in FIGS. 2 and 3. FIG. 2 shows pulse combustor 10 operating as a steam boiler where pulse combustor 10, exhaust tubes 20 and exhaust manifold 22 are submerged within shell 28. Liquid level 29 indicates the water level or other liquid level within shell 28.

Several design considerations exist for a pulse combustor according to this invention. Main combustion chamber 15 must have the proper size for a prescribed fuel/air mixture input range. An oversized main combustion chamber 15 may lack proper aspiration capabilities. An undersized main combustion chamber 15 may generate excessive noise levels which are difficult and costly to attenuate. Main combustion chamber 15 must have enough surface area to provide proper heat transfer and main combustion chamber wall 35 and/or combustion chamber branch walls 36 must have enough surface area for easy and proper attachment of exhaust tubes 20. As the cross-sectional area of combustion chamber branches 16 decreases, velocity of the hot combustion products increases thus improving heat transfer. Reinforcement struts 25 provide rigid support for combustion chamber branch walls 36 and also reduce the vibration of the sheet metal surfaces of combustion chamber branch walls 36.

For a combustor having a given total volume of the combustion chamber and any associated combustion chamber branches, pulse combustor 10 according to this invention will have greater overall heat transfer and thus greater heat transfer per unit of surface area than a conventional single combustion chamber pulse combustor having the same total volume.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A pulse combustor comprising: at least one mixing and ignition chamber wall forming a mixing and ignition chamber, fuel inlet means, air inlet means, said mixing and ignition chamber in communication with said fuel inlet means and said air inlet means, fuel being introduced through said fuel inlet means and combustion air being introduced through said air inlet means forming a combustible fuel/air mixture in said mixing and ignition chamber, ignition means for igniting said combustible fuel/air mixture;

at least one combustion chamber wall forming a combustion chamber, said combustion chamber in communication with said mixing and ignition chamber, said combustion chamber having a plurality of downstream combustion chamber branches, said combustion chamber branches having an opening between at least one combustion chamber branch wall of each of said combustion chamber branches; and a plurality of exhaust tubes having one end in communication with said combustion chamber branches, said exhaust tubes secured to each said combustion chamber branch along a longitudinal axis of said combustion chamber branch.

2. A pulse combustor according to claim 1 further comprising an exhaust manifold in communication with opposite ends of said exhaust tubes.

3. A pulse combustor according to claim 1 wherein said fuel inlet means further comprises a fuel inlet tube sealably secured to said at least communication with said mixing and ignition chamber.

4. A pulse combustor according to claim 1 wherein said air inlet means further comprises an air inlet tube sealably secured to said at least one mixing and ignition chamber wall and in communication with said mixing and ignition chamber.

5. A pulse combustor according to claim 1 wherein said at least one combustion chamber wall has corrugated sides.

6. A pulse combustor according to claim 1 wherein said at least one combustion chamber branch wall has corrugated sides.

7. A pulse combustor according to claim 1 wherein a plurality of fins are secured to said at least one combustion chamber wall and said at least one combustion chamber branch wall.

8. A pulse combustor according to claim 1 wherein said combustion chamber branches each have a cross-sectional area less than a cross-sectional area of said combustion chamber.

9. A pulse combustor according to claim 1 wherein each said exhaust tube has a cross-sectional area less than the cross-sectional area of said combustion chamber branch with which said exhaust tube is in communication.

10. A pulse combustor according to claim 1 wherein said ignition means further comprises at least one spark plug mounted to discharge a spark within said mixing and ignition chamber.

11. A pulse combustor according to claim 1 wherein said combustion chamber branches of said combustion chamber further comprise at least one reinforcing strut secured between said at least one combustion chamber branch wall of adjacent said combustion chamber branchs 12. A pulse combustor according to claim 1 wherein said exhaust tubes have a downwardly sloped configuration.

13. A pulse combustor according to claim 12 wherein said exhaust tubes have a staggered configuration.

14. A pulse combustor according to claim 1 wherein said exhaust tubes are in communication with said combustion chamber.

15. A pulse combustor according to claim 14 wherein said exhaust tubes are sealably secured to said at least one combustion chamber wall and said at least one combustion chamber branch wall.

16. A pulse combustor according to claim 1 wherein said exhaust tubes are sealably secured to said at least one combustion chamber branch wall.

17. A pulse combustor according to claim 1 wherein said combustion chamber branches extend longitudinally from said combustion chamber.

18. An improved pulse combustor of the type having a mixing chamber, ignition chamber, fuel inlet means and air inlet means, said air inlet means and said fuel inlet means introducing combustion air and fuel respectively to form a combustible fuel/air mixture, and ignition means for igniting said combustible fuel/air mixture, wherein the improvement comprises: said combustion chamber having a plurality of downstream combustion chamber branches, said combustion chamber branches having a slot between at least one combustion chamber branch wall of each said combustion chamber branch, and a plurality of exhaust tubes having on end in communication with said combustion chamber branches.

19. An improved pulse combustor according to claim 18 further comprising an exhaust manifold in communication with said exhaust tubes.

20. An improved pulse combustor according to claim 18 wherein the cross-sectional area of each said combustion chamber branch is less than the cross-sectional area of said combustion chamber.

21. An improved pulse combustor according to claim 18 wherein the cross-sectional area of each said exhaust tube is less than the cross-sectional area of each said combustion chamber branch with which said exhaust tube is in communication.

22. An improved pulse combustor according to claim 18 wherein said combustion chamber branches of said combustion chamber further comprise at least one reinforcing strut secured between said at least one combustion chamber branch wall of each said combustion chamber branch.

23. An improved pulse combustor according to claim 22 wherein said exhaust tubes have a staggered configuration.

24. An improved pulse combustor according to claim 18 wherein said exhaust tubes are in communication with said combustion chamber.

25. An improved pulse combustor according to claim 24 wherein said exhaust tubes are sealably secured to said at least one combustion chamber wall and said at least one combustion chamber branch wall.

26. An improved pulse combustor according to claim 18 wherein said exhaust tubes are sealably secured to said at least one combustion chamber branch wall.

* * * * *